US005479955A

United States Patent [19]

Roodvoets et al.

[11] Patent Number: 5,479,955

[45] Date of Patent: Jan. 2, 1996

[54] METHOD AND APPARATUS FOR ASEPTICALLY FILLING CONTAINERS

[75] Inventors: Mark R. Roodvoets, Inman; Jeffrey L. Girman, Simpsonville, both of S.C.; Philip E. Nelson, West Lafayette; Richard S. Smith, Lafayette, both of Ind.

[73] Assignee: Spartanburg Steel Products, Inc., Spartanburg, S.C.

[21] Appl. No.: 251,265

[22] Filed: May 31, 1994

[51] Int. Cl.[6] ..... B08B 3/04; B08B 9/06

[52] U.S. Cl. ..... 137/15; 137/240; 137/241; 137/315; 137/319; 141/85; 222/148

[58] Field of Search ..... ; F16K 43/00

[56] References Cited

U.S. PATENT DOCUMENTS

| | | | |
|---|---|---|---|
| 3,517,688 | 6/1970 | Scholle | 137/240 |
| 3,633,607 | 1/1972 | Werra | 137/241 |
| 4,325,401 | 4/1982 | Ukai et al. | 137/240 |
| 4,383,548 | 5/1983 | Durenec et al. | 137/321 |
| 4,420,012 | 12/1983 | Astrom | 137/319 |
| 4,445,550 | 5/1984 | Davis et al. | 141/329 |
| 4,494,363 | 1/1985 | Rica et al. | 53/426 |
| 4,570,665 | 2/1986 | Zimmerly | 137/241 |
| 4,819,691 | 4/1989 | Lofgren et al. | 251/331 |
| 4,836,236 | 6/1989 | Ladisch | 137/241 |
| 4,890,639 | 1/1990 | Loliger et al. | 137/241 |
| 4,899,780 | 2/1990 | Astrom | 137/319 |
| 4,922,951 | 5/1990 | Webster | 137/315 |
| 5,152,500 | 10/1992 | Hoobyar et al. | 251/269 |

OTHER PUBLICATIONS

Flush-Mounted Tank Valve, Advanced Aseptic Process Equipment, Suite 301, 1101 San Antonio Rd., Mountain View, Calif. 94043; 2 Pages; Date Unknown.

FluidFlow Ball Vavles, Lee Industries, Inc., P.O. Box 688, Philipsburg, Pa. 16866; 1 Page; Date Unknown.

A Different Angle Means Pure Performance, LUMACO; Address Unknown; 4 Pages; Date Unknown.

The New Aseptic Valve Generation, SUDMO, Address Unknown; 4 Pages; Date Unknown.

*Primary Examiner*—George L. Walton

*Attorney, Agent, or Firm*—Renner, Kenner, Greive, Bobak, Taylor & Weber

[57] ABSTRACT

An aseptic valve assembly (10) is provided for filling and discharging containers. A valve fitting (11) is fixably attached in a bottom wall (19) of a container (20). A plug (12) may be secured within the container fitting (11). A sterilization/fill unit (14) is removably attached to the container fitting (11) so that the container (20), the plug (12) and the container fitting (11) may be sterilized and the container (20) filled and sealed under aseptic conditions.

14 Claims, 4 Drawing Sheets

METHOD AND APPARATUS FOR ASEPTICALLY FILLING CONTAINERS

TECHNICAL FIELD

This invention relates to an aseptic valve assembly for product containers, for example, of the type used to fill and discharge stainless steel containers used for the transportation and storage of food products. More particularly, this invention relates to a reusable assembly which allows the container and valve to be sterilized, and the container filled and sealed without the need to permanently affix the sterilization valve assembly to the container.

BACKGROUND ART

For many years containers used to hold food products have employed aseptic valves. Such valves have allowed a sterilized container to be filled and discharged without contaminating the product with outside contaminants. Further, such valves frequently include steam tracing ports, whereby steam may be introduced into the valve and container for sterilization thereof prior to filling with product. As should be apparent, such valves involve elaborate mechanisms for aseptically opening and closing the valve as well as to facilitate drainage and sterilization. These rather involved mechanisms make the costs of such valves prohibitively expensive for use with returnable container systems.

Other systems employ an aseptic bag within a box container which uses a plug type valve wherein the plug is punctured for filling purposes and then a lid is heat sealed in place after filling. The container is then punctured when the contents are to be used. The container may not be resealed and all of the product must be used at once. This system also has the disadvantage of requiring special piercing tools.

Thus, there is clearly a need in the art for a portable, reusable, positive seal valve which can be sterilized along with the container and opened and closed under aseptic conditions. The portable component of the valve must be inexpensive relative to the elaborate aseptic valves found in the prior art.

DISCLOSURE OF THE INVENTION

It is thus a primary object of the present invention to provide an aseptic valve which allows a container to be filled and discharged without contaminating the product.

It is another object of the present invention to provide an aseptic valve, as above, in which the valve and container may be sterilized prior to filling with product.

It is a further object of the present invention to provide an aseptic valve, as above, which utilizes an inexpensive fitting which may be transported with the container and a fill/sterilization unit which may be disconnected from the container after filling.

It is yet another object of the present invention to provide an aseptic valve, as above, which allows the container to be sealed under aseptic conditions.

It is a still further object of the present invention to provide an aseptic valve, as above, which is easy to operate and inexpensive to manufacture.

It is a still further object of the present invention to provide a method whereby a container may be sterilized.

It is yet another object of the present invention to provide a method whereby a container may be filled and sealed under aseptic conditions.

These and other objects of the present invention which will become apparent from the description to follow, are accomplished by the improvements hereinafter described and claimed.

In general, an aseptic valve assembly is to be used for aseptically filling and discharging containers having a fitting member and a plug received within the fitting member to close access to the inside of the container. The valve assembly includes a housing having at least one port for the introduction of a sterilizing reagent and at least one container filling and discharge port. A coupler may be employed to attach the housing to the fitting member. A plunger is slidably received in the housing and is adapted to engage and remove the plug from the fitting member when the housing is attached to the fitting member. The container, plug, housing, and plunger are sterilized by the introduction of a sterilizing reagent through the port and the container is filled or discharged through the filling and discharge port.

A combination of a container and an aseptic valve assembly is provided for aseptically filling and discharging the container. The container has a valve fitting in the bottom wall thereof and a plug member is matably received within the valve fitting. The valve assembly includes a sterilization/fill housing removably attached to the valve fitting so that the container, the plug and the valve fitting may be sterilized and the container filled and sealed under aseptic conditions.

The present invention also provides a method of sterilizing a container having a fitting member adapted to receive a plug. The method includes the steps of positioning the plug on the end of a plunger of a sterilization housing; coupling the sterilization housing to the fitting member; and introducing a sterilizing reagent into the sterilization housing, to sterilize the housing, the plug, the plunger, the fitting member and the container.

A preferred exemplary aseptic valve assembly incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
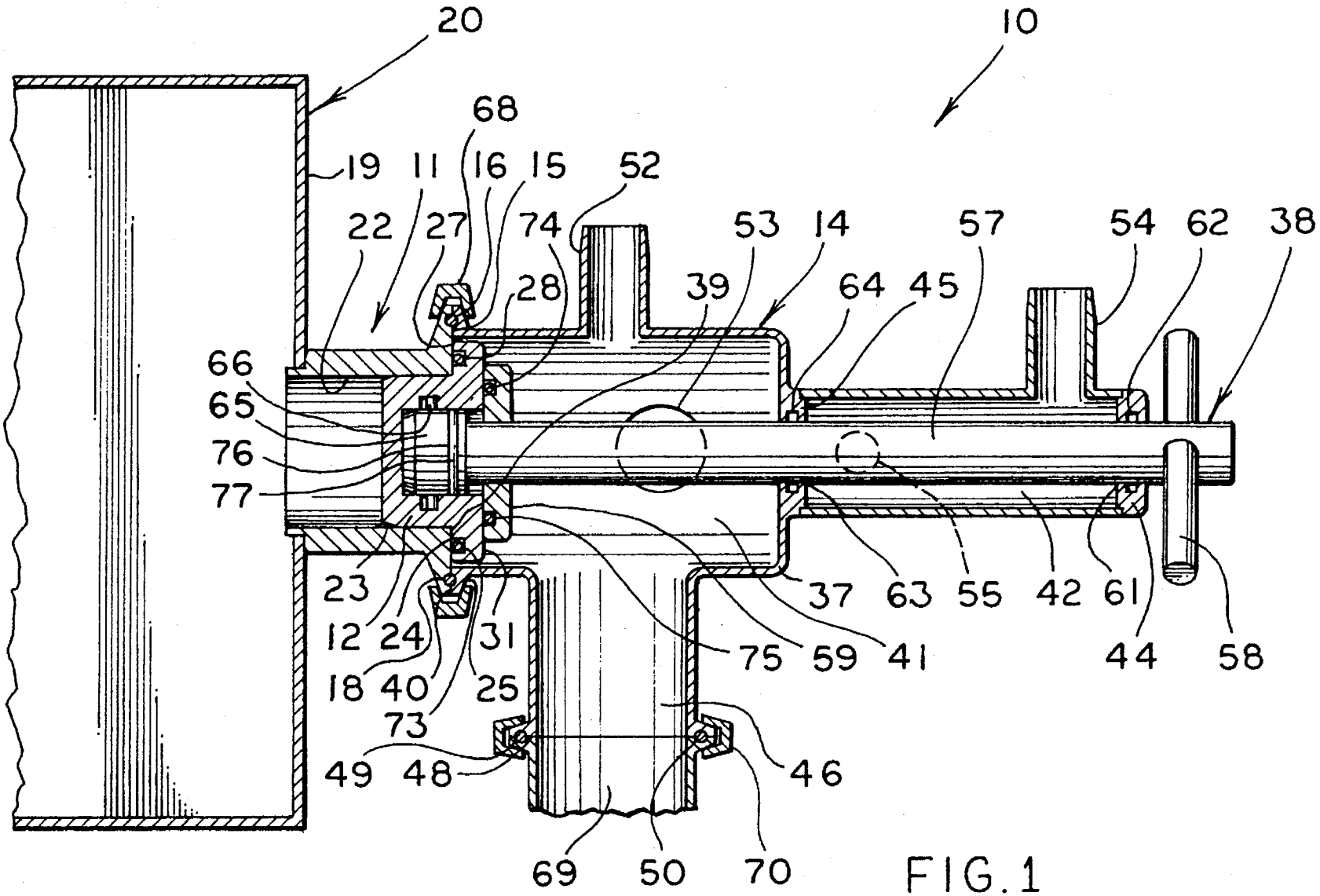
FIG. 1 is a cross sectional top view of the aseptic valve assembly according to the concept of the present invention taken along a section through the longitudinal axis thereof.

An aseptic valve assembly made in accordance with the concept of the present invention is indicated generally by the numeral 10 in the accompanying drawings. With reference to FIG. 1, it can be seen that aseptic valve assembly 10 is adapted to be used with a valve fitting 11 and includes a plug 12 and a sterilization/fill unit 14. As shown, valve fitting 11 is a generally cylindrical shaped conduit having a flanged front face 15 which includes a sealing groove 16 capable of receiving a conventional O-ring 18, or other appropriate sealing device such as a gasket or the like. Valve fitting 11 is adapted to be mounted in a wall 19, preferably the bottom, of a container 20. Such mounting may be accomplished in any number of known ways such as welding, press fitting or threading. Similarly, the wall 22 of fitting 11 may include threads, snap notches or other appropriate means for securing plug 12 therein.

Plug 12 includes a reduced diameter portion 23 and a flanged portion 24. Reduced diameter portion 23 is of approximately the same diameter as the interior of valve fitting 11 and includes threads, snap notches or other appropriate means so that it may be matably received therein. Flanged portion 24 has a seal receiving groove 25 in its rear face 27 which receives a seal 28 such as a conventional O-ring or the like. Thus, seal 28 provides a seal between flanged portion 24 of plug 12 and flanged front face 15 of valve fitting 11.

Figure 4:
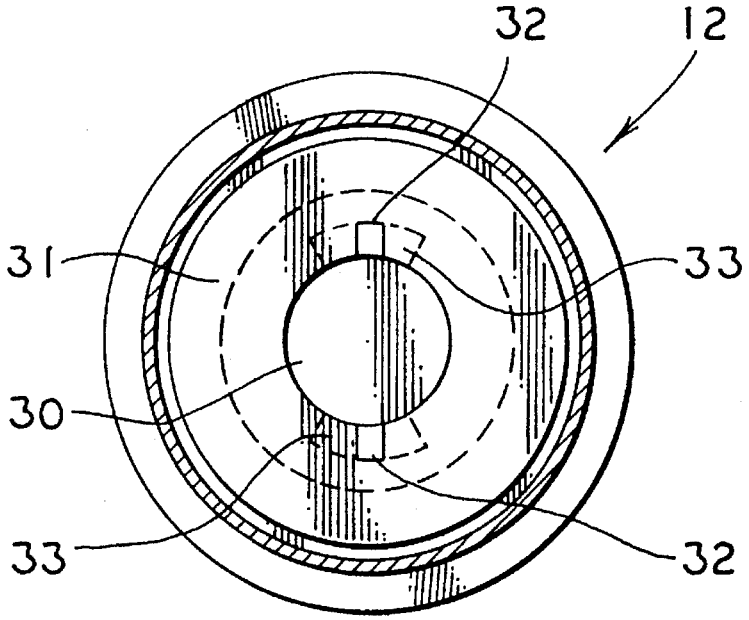
FIG. 4 is a sectional front view of the container valve fitting with plug installed taken substantially along line 4—4 of FIG. 3.
Figure 5:
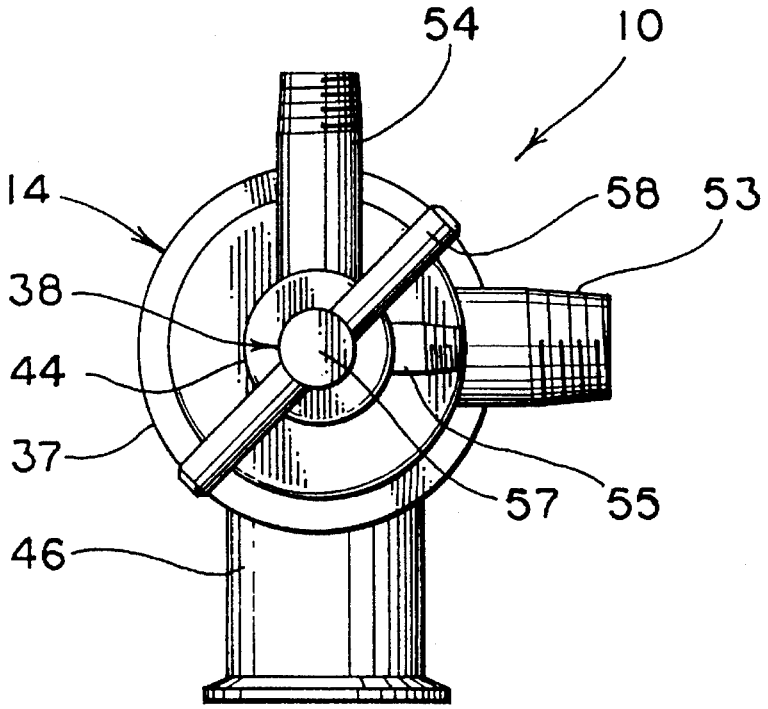
FIG. 5 is a front elevational view of the aseptic valve assembly according to the present invention.

As shown in FIG. 4, plug 12 further includes a bore 30 in its front face 31. Bore 30 is interrupted about its circumference by a pair of diametrically opposed notches 32 which open into a pair of arcuate recesses 33 disposed adjacent to bore 30.

Figure 2:
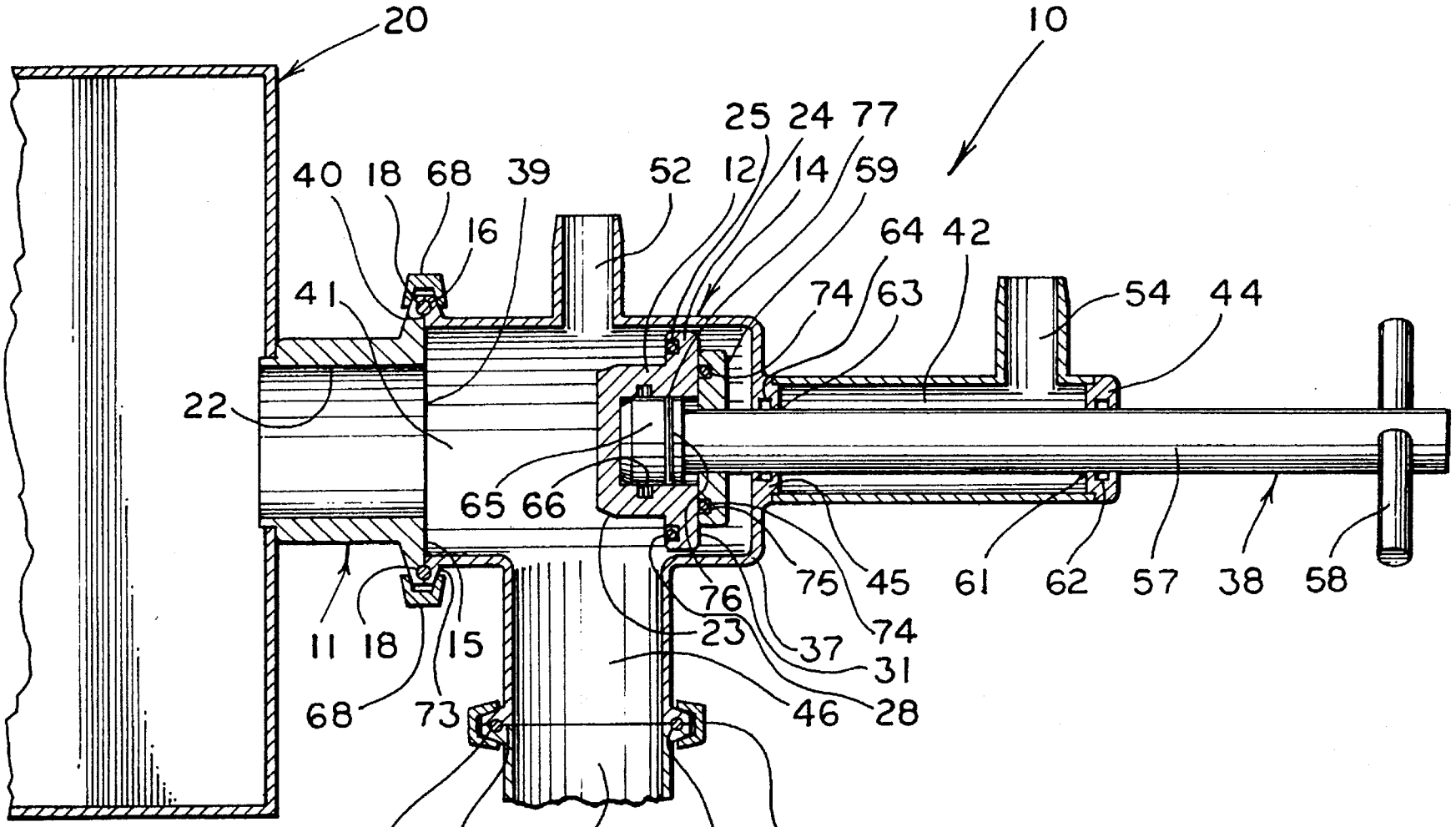
FIG. 2 is a view similar to FIG. 1 but showing the plug removed from the container valve fitting.
Figure 3:
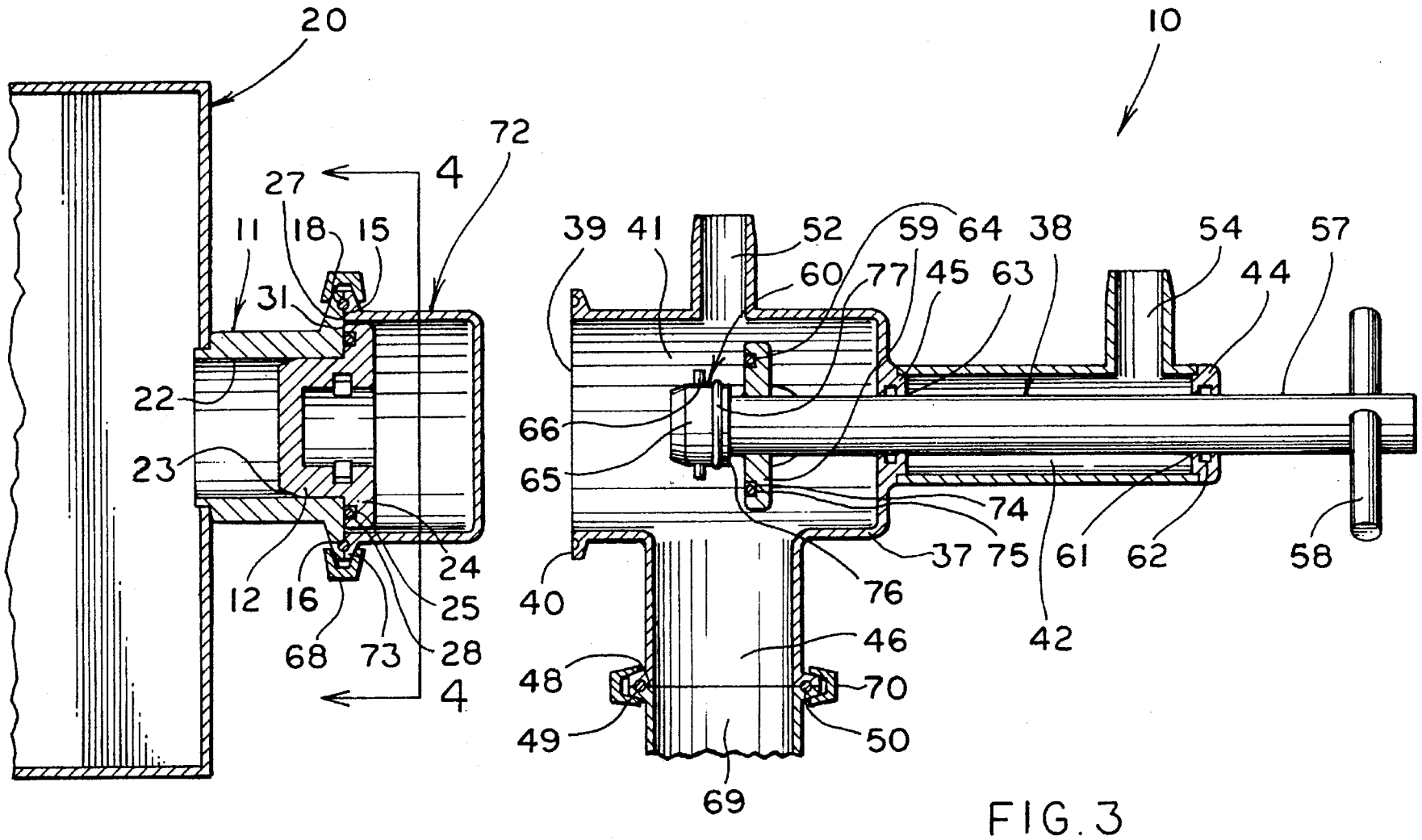
FIG. 3 is a view similar to FIG. 1 but showing the fill/sterilization unit disengaged from the container valve fitting and with the plug and cap installed.

Referring now to FIGS. 1–3, sterilization/fill unit 14 includes a housing 37 and a plunger 38. Housing 37 is of a generally cylindrical shape having an open end 39 with a flanged end face 40. Housing 37 is divided into two chambers, a main sterilization chamber 41 positioned adjacent to open end 39 of housing 37, and a shaft sterilization chamber 42 positioned adjacent to the closed end 44 of housing 37. Chamber 42 is separated from main sterilization chamber 41 by a wall 45. Main sterilization chamber 41 includes a filling and discharge port 46 having a flanged end face 48. A seal receiving groove 49 is included in end face 48 to receive a seal 50 such as an O-ring or other appropriate means. Main sterilization chamber 41 further includes a reagent port 52 disposed opposite filling and discharge port 46. A drain port 53 is also included in the bottom of main sterilization chamber 41. Reagent port 52 and drain port 53 are each preferably fitted with conventional NPT type threads for connection to appropriate reagent and drain hoses. Similarly, shaft sterilization chamber 42 includes a reagent port 54 disposed in the side thereof and a drain port 55 disposed in the bottom thereof.

Plunger 38 includes a shaft 57, a tee-handle 58, a plug sealing flange 59, and an engaging head 60 (FIG. 3) disposed within housing 37. Plunger shaft 57 is fitted into housing 37 through a shaft aperture 61 in closed end 44 of housing 37 adjacent to shaft sterilization chamber 42. An annular seal receiving groove 62 is included around shaft aperture 61 so that an O-ring or other appropriate sealing means may provide a seal between housing 37 and shaft 57. Similarly, shaft 57 further penetrates wall 45 through a shaft aperture 63 therein which likewise includes a seal receiving groove 64. It should be apparent, therefore, that when plunger 38 is slidably positioned in housing 37, plug sealing flange 59 and engaging head 60 will be located within main sterilization chamber 41 and tee-handle 58 is located outside the housing so that plunger 38 may be readily manipulated by the user. Plug sealing flange 59 is included on plunger 38 proximal to engaging head 60. Flange 59 is generally disk shaped and includes a seal receiving groove 74, on one side thereof, which may receive an O-ring 75 or other appropriate sealing means.

As best shown in FIG. 3, engaging head 60 includes a generally cylindrical shaped main body portion 65 which is of a diameter slightly smaller than that of bore 30 of plug 12. Body portion 65 may be beveled at its end so that it may be more readily received within plug bore 30. Engaging head 60 further includes an O-ring receiving groove 76 about the circumference of body portion 65, and a pair of diametrically opposed lugs 66 which extend outwardly from body portion 65. Lugs 66 are utilized to attach plunger 38 to plug 12. To this end, beveled body portion 65 of head 60 is received in bore 30 of plug 12, with lugs 66 being aligned with notches 32. When head 60 is fully within plug 12, shaft 57 may be rotated via handle 58 to position lugs 66 within arcuate recesses 33 to lock plug 12 onto plunger 38. When plug 12 is locked onto plunger 38, plug sealing flange 59 abuts front face 31 of plug 12 and O-ring 75 is interposed between the flange 59 and the face 31 to maintain a positive seal therebetween. The positioning of an O-ring 77 around the outer diameter of head 60 in groove 76 additionally holds plug 12 on shaft 57.

Sterilization/fill unit 14 may then be mounted to valve fitting 11. Such is accomplished by abutting flanged front face 15 of valve fitting 11 with flanged end face 40 of housing 37 and ensuring that O-ring 18 or other appropriate seal is interposed between the flanged faces. When the faces are abutted and aligned, a coupler 68 such as a conventional tri-clamp or I-line fitting may be tightened around the flanges to maintain secure engagement. A fill or discharge hose 69 is similarly connected to flanged end face 48 of filling and discharge port 46 by using a second coupler 70.

After all hoses and fittings have been properly connected, with the components in the FIG. 2 position, container 20, valve fitting 11, plug 12, and plunger 38 may be sterilized along with the interior of sterilization/fill unit 14 by admitting high pressure steam or other appropriate reagent into valve assembly 10 via reagent ports 52 and 54. Once sterilization has been accomplished, a product may be directed into container 20 via filling and discharge port 46. As should be apparent the seal maintained between the face 31 of plug 12 and the plug sealing flange 59 prevents bore 30 and recesses 33 from becoming fouled with product thereby eliminating the need to clean or sterilize the bore 30 and recesses 33. After container 20 has been filled, plug 12 may be fitted into valve fitting 11. This is accomplished by sliding plunger 38 toward container 20 until plug 12 is positioned at valve fitting 11 as previously described. Rotation of tee-handle 58 with lugs 66 in recesses 33 threads plug 12 into valve fitting 11. The flanged portion 24 of plug 12 is thus firmly seated against flanged front face 15 of valve fitting 11 and securely sealed by O-ring 28. Container 20 is thus aseptically sealed, and by rotating handle 58 in the opposite direction, lugs 66 may be aligned with notches 32 and plunger 38 may be released and withdrawn from plug 12. Sterilization/fill unit 14 may be disconnected from container 20 by simply loosening the coupler 68 leaving plug 12 behind as shown in FIG. 3. As should be apparent to those skilled in the art, sterilization/fill unit 14 may then be utilized to sterilize and fill additional containers 20. Each container 20 would only require the relatively inexpensive valve fitting 11 and plug 12. As should also be apparent, a container 20 may be aseptically discharged by simply attaching sterilization/fill unit 14 to valve fitting 11, sterilizing the plug 12, plunger 38 and housing 37 by admitting a sterilizing reagent into the unit 14 and using the plunger to remove the plug 12.

A dust cover 72 may also be provided to assist in maintaining the cleanliness of valve fitting 11 and plug 12 during transport. As shown in FIG. 3, cover 72 includes a peripheral flange 73 which allows it to be matingly coupled to valve fitting 11 using a coupler 68.

It should thus be appreciated that aseptic valve assembly 10 not only provides the opportunity to aseptically fill and discharge containers but also affords the opportunity to do away with the expensive and inconvenient valves of the prior art. The above-described invention thus accomplishes the objects of the present invention and otherwise improves the art.

We claim:

1. A valve assembly adapted to engage temporarily and detachably a container for the purpose of sterilizing and aseptically filling and discharging the container, the container having a fitting member and a plug received within the fitting member to close access to the inside of the container, the valve assembly comprising a housing having at least one port for the introduction of a sterilizing reagent and at least one container filling and discharge port, means to removably attach said housing to the fitting member, and a plunger slidably received in said housing and adapted to detachably engage and remove the plug from the fitting member when said housing is attached to the fitting member so that the container, the plug, the fitting member, said housing and said plunger may be sterilized by the introduction of a sterilizing reagent through said port and the container filled and discharged through said filling and discharge port after the plug the fitting member, said housing and said plunger have been sterilized and said housing may be detached from the fitting and used to sterilize, and aseptically fill and discharge other containers.

2. A valve assembly according to claim 1 wherein the plug is provided with a bore to receive one end of said plunger, and is provided with at least one notch which opens into at least one arcuate recess, said one end of said plunger having at least one lug received in the notch, said plunger being rotatable to position said lug in said recess.

3. A valve assembly according to claim 1 wherein the fitting member has a flanged front face and said housing has a flanged end face adapted to mateably abut said flanged front face of said fitting member.

4. A valve assembly according to claim 1 wherein said housing includes a main sterilization chamber having a said port for the introduction of a sterilizing reagent and one drain port; and a shaft sterilization chamber having another said port for the introduction of a sterilizing reagent and one drain port.

5. A valve assembly according to claim 4 wherein said sterilizing reagent is high pressure steam.

6. A valve assembly according to claim 1 further comprising means to cover said fitting member and said plug, said means to cover being removably mounted to said fitting member.

7. In combination, a container and an aseptic valve assembly adapted to engage temporarily and detachably said container for sterilizing and aseptically filling and discharging said container, said container having a valve fitting in a wall thereof and a plug member received within said valve fitting, said valve assembly having a sterilization and fill housing removably attached to said valve fitting so that said container, said plug member and said valve fitting may be sterilized, and said container filled and said plug sealably engaged to said valve fitting under aseptic conditions so that said housing can be detached from said fitting and used to sterilize and aseptically fill and discharge other containers.

8. The combination of claim 7 wherein said valve fitting is a cylindrical conduit having a flanged front face.

9. The combination of claim 8 wherein said plug member is generally cylindrical in configuration having a reduced diameter portion, a flanged portion, a bore and at least one notch which opens into at least one arcuate recess adjacent to said bore.

10. The combination of claim 7 wherein said sterilization and fill housing includes at least one sterilization chamber, at least one reagent port, at least one drain port and at least one filling and discharge port and further comprising a plunger slidably received in said housing having a shaft, a handle and means to detachably engage said plug member.

11. The combination of claim 10 wherein said means to engage said plug member includes at least one lug means to engage said arcuate recess so that said plug member may be removed from said valve fitting by rotating said handle and sliding said shaft.

12. The combination of claim 7 further comprising means to couple said housing with said valve fitting.

13. The combination of claim 7 further comprising means to cover said valve fitting and said plug member, said means to cover being removably mounted over said valve fitting.

14. A method of sterilizing, filling and discharging a container having a fitting member adapted to removably receive a plug comprising the steps of: positioning the plug on an end of a plunger in a sterilization housing; detachably coupling the sterilization housing with the fitting member; introducing a sterilizing reagent into the sterilization housing, to sterilize the housing, the plug, the plunger, the fitting member and the container; aseptically filling the container with a product by introducing the product into the sterilization housing through a filling port; engaging the plug with the fitting member by manipulating the plunger; and disengaging the sterilization housing from the fitting member so that the sterilization housing may be used to sterilize, and aseptically fill and discharge other containers.

* * * * *